US011654459B2

(12) United States Patent
Mestichelli

(10) Patent No.: US 11,654,459 B2
(45) Date of Patent: May 23, 2023

(54) CLEANING WIPER FOR GROCERY CONVEYOR BELT

(71) Applicant: William Mestichelli, Moorestown, NJ (US)

(72) Inventor: William Mestichelli, Moorestown, NJ (US)

( * ) Notice: Subject to any disclaimer, the term of this patent is extended or adjusted under 35 U.S.C. 154(b) by 0 days.

(21) Appl. No.: 16/850,138

(22) Filed: Apr. 16, 2020

(65) Prior Publication Data

US 2021/0323031 A1 Oct. 21, 2021

(51) Int. Cl.

| | |
|---|---|
| ***B08B 1/00*** | (2006.01) |
| ***B08B 1/02*** | (2006.01) |
| ***B08B 3/04*** | (2006.01) |

(52) U.S. Cl.

CPC ..... *B08B 1/02* (2013.01); *B08B 1/006* (2013.01); *B08B 3/041* (2013.01); *B08B 1/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,978,875 | B2 | 3/2015 | Barboni | |
| 9,096,392 | B1 | 8/2015 | Barragan | |
| 2007/0048063 | A1* | 3/2007 | Bauer | B32B 7/06 401/7 |
| 2010/0243410 | A1 | 9/2010 | Hall et al. | |
| 2020/0277146 | A1* | 9/2020 | Hoover | B41J 13/08 |

* cited by examiner

*Primary Examiner* — Erin F Bergner
(74) *Attorney, Agent, or Firm* — Norman E. Lehrer

(57) ABSTRACT

A cleaning wiper blade for a moving grocery conveyor belt in the form of a thin sheet of paperboard, cardboard or plastic material having a length which is essentially the same as said width of the belt. The underside of the sheet includes first, second and third areas all having a width and a length wherein the lengths are substantially equal to the length of the sheet. The first area includes an adhesive thereon adapted to be temporarily secured to the frame of the conveyor and is covered by a release paper. The second area includes a porous member having a quantity of a liquid cleaning agent and a protective covering for the member to prevent the liquid agent from being released. The third area includes material capable of wiping liquid from the belt. The cleaning wiper blade is capable of being attached to the conveyor by removing the release paper and the protective covering and securing the first area of the sheet of to the conveyor frame with the second and third areas contacting the upper surface of the belt as it moves.

4 Claims, 3 Drawing Sheets

CLEANING WIPER FOR GROCERY CONVEYOR BELT

BACKGROUND OF THE INVENTION

The present invention is directed toward a cleaning device for a grocery or food store conveyor belt and, more particularly, toward such a device that is inexpensive and easy to use and that will first wipe a cleaning solution onto a moving belt and then immediately wipe off any excess cleaning solution in order to clean and dry the belt.

As is well known in the art, conveyor belts used in store checkouts and particularly grocery stores, supermarkets and the like can be a source of contamination of foods or other purchased items, due to the large number of items that are in physical contact with the conveyor belt. Not only food products but cleaning products and the like frequently come in contact with the belt surfaces. Food products themselves may leak and leave liquids on the belt that can spoil or attract mold or fungus. Even further, individuals may also touch the belt, which may lead to direct exposure to various diseases. Conveyor belts, however, are not easily removed and cleaning is typically not performed on a regular basis. Accordingly, this can lead to both real and perceived dangers of contamination from the conveyor belt.

Several systems have been proposed that address conveyor belt cleaning and sanitizing. They all, however, are complex and difficult to maintain. For example, U.S. Patent Publication 2010/0243410 discloses a cleaning system with a hollow porous roller situated below and on the underside of the conveyor belt, out of sight of the top or conveying surface of the belt. A perforated rod, positioned within the hollow porous roller, contains a cleaning and sanitizing solution that can be dispensed through a series of perforations in the rod. The cleaning and sanitizing solution is distributed via a pump from a tank reservoir.

U.S. Pat. No. 9,096,392 is directed to a steam cleaning system that includes a steam spraying unit and a wiping unit. The wiping unit includes a disposable, absorbable microfiber roller which is disposed across and in contact with the conveyor belt surface and a steamer unit is disposed below the conveyor. The steamer unit includes a boiler, a water collection tray, a pump, a filter and an actuator and is, therefore, quite complex.

U.S. Pat. No. 8,978,875 is also directed to a conveyor belt cleaning system which is adapted to clean the outer surface of the belt. A fluid dispenser dispenses cleaning fluid to the upper surface of the conveyor belt and a wiping device removes excess cleaning fluid. However, the system requires a reservoir to store the cleaning fluid and pump to pump the fluid to the dispenser, which, again, makes the system somewhat complex.

A need exists, therefore, for a simple system for cleaning the upper surface of a grocery store conveyor belt that is cost effective and easy to use.

SUMMARY OF THE INVENTION

The present invention is designed to overcome the deficiencies of the prior art discussed above. It is an object of the present invention to provide a cleaning wiper blade for a moving grocery conveyor belt.

It is another object of the present invention to provide a cleaning wiper blade for a moving grocery conveyor belt that is inexpensive so as to be disposable.

It is a still further object of the present invention to provide such a cleaning wiper blade for a moving grocery conveyor belt that is easy to apply and remove.

In accordance with the illustrative embodiments demonstrating features and advantages of the present invention, there is provided a cleaning wiper blade for a moving grocery conveyor belt in the form of a thin sheet of paperboard, cardboard or plastic material. The sheet of material has a length which is essentially the same as said width of the belt. The underside of the material includes first, second and third areas all having a width and a length wherein the lengths are substantially equal to the length of the material. The first area includes an adhesive which is adapted to be temporarily secured to the frame of the conveyor and is covered by a release paper. The second area includes a porous member having a quantity of a liquid cleaning agent and a protective covering for the member to prevent the liquid agent from being released or otherwise drying out. The third area includes material capable of wiping liquid from the belt to dry the same. The cleaning wiper blade is attached to the conveyor by removing the release paper and the protective covering and securing the first area of the sheet of material to the conveyor frame with the second and third areas contacting the upper surface of the belt as it moves.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figures 1, 2:
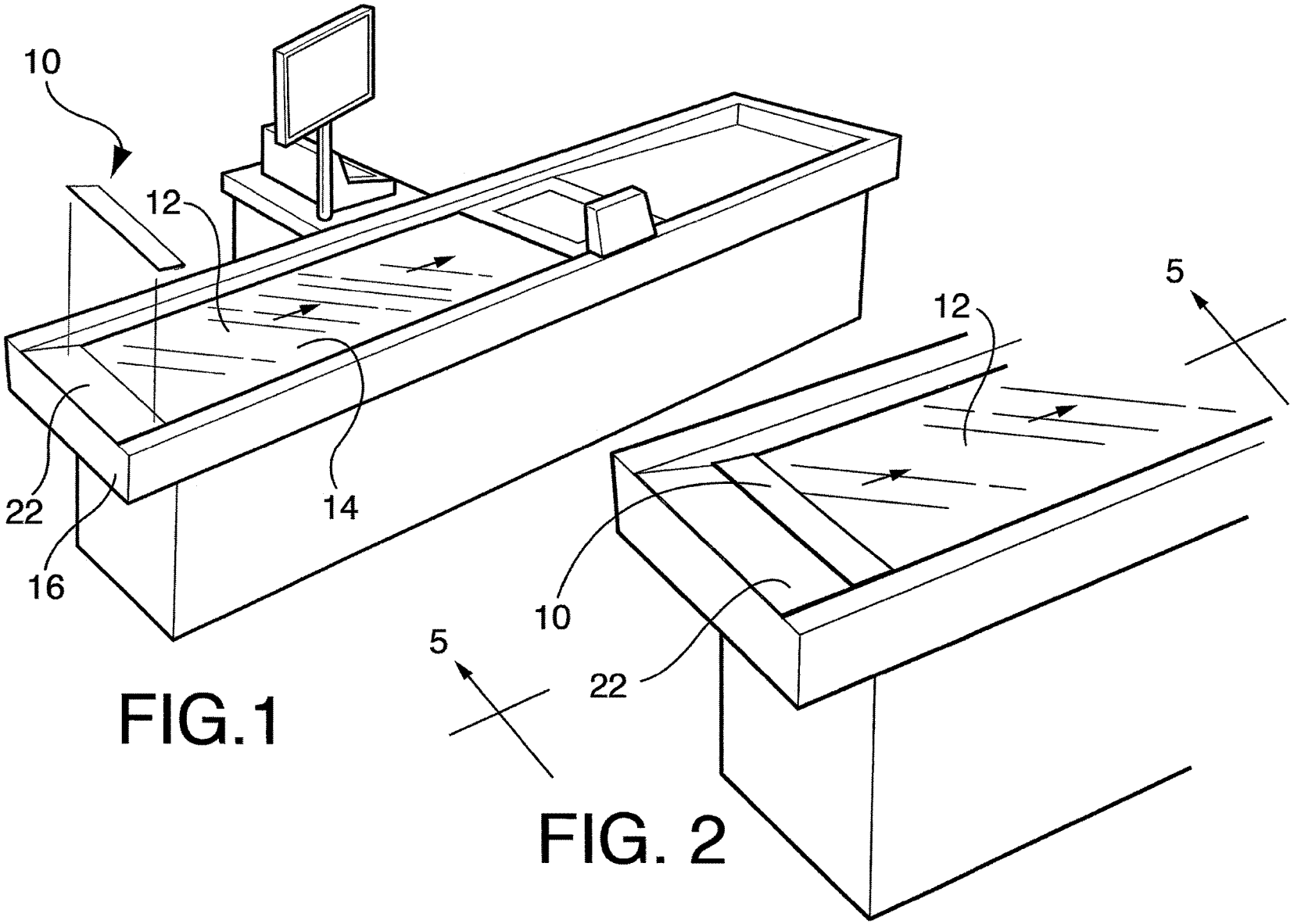
FIG. 1 is a front perspective view of a grocery store checkout counter with a conveyor belt and showing the invention about to be attached thereto.
FIG. 2 is a view similar to FIG. 1 but showing the invention attached to the conveyor.

Referring now to the drawings in detail wherein like reference numerals have been used throughout the various figures to designate like elements, there is shown in FIGS. 1-5 a cleaning wiper blade for a grocery conveyor constructed in accordance with the principles of the present invention and designated generally as 10. The wiper blade 10 is intended to be used to clean the entire width of the upper surface 12 of the moving belt 14 of the conveyor assembly 16 as it is moving.

The conveyor assembly 16 is of essentially known conventional construction. Accordingly, it is not believed that a detailed description thereof is necessary. Briefly, and as shown best in FIG. 5, the conveyor assembly 16 includes a frame 18 that supports a rotating wheel or roller 20. Not shown is a second roller at the other end of the conveyor for supporting the closed loop belt 14. In use, the belt 14 moves in the direction shown in the arrows in the figures.

Figure 5:
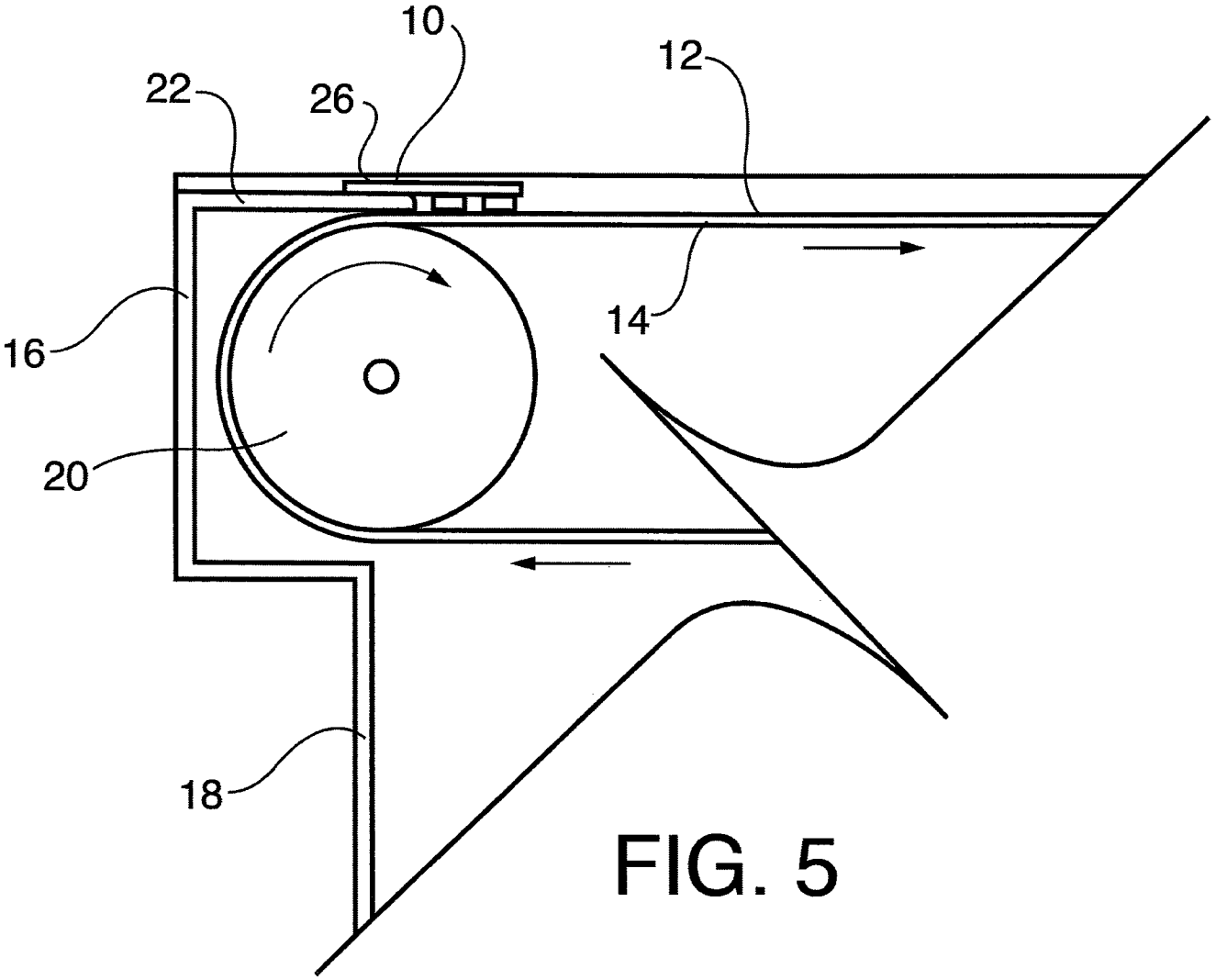
FIG. 5 is a cross sectional view taken through the line 5-5 of FIG. 2.

The conveyor frame 18 includes an upper frame member 22 that covers the upper surface 12 of the belt 14 as it emerges from beneath and moves outwardly and away from the frame member 22. As shown in FIG. 5, the frame member 22 is essentially a thin sheet of metal. In most grocery store conveyor systems, the frame member 22 is essentially horizontally arranged as shown in the figures. In some conveyor systems, however, the frame member 22 slants downwardly somewhat from a higher position down to the upper surface 12 of the belt 14.

The cleaning wiper blade 10 is comprised essentially of a thin sheet of sheet-like material 24 such as paperboard, cardboard, plastic or metal or combinations thereof. The sheet 24 must be self-supporting but able to flex somewhat to have a slight springy effect. The sheet 24 has a length which is essentially the same as the width of the belt 14. The width of the sheet 24 is preferably between approximately 8 and 15 inches although the width is not critical to the operation of the invention as should become readily apparent to those skilled in the art.

The sheet of material 24 has an upper surface 26 and a lower surface 28. The lower surface 28 includes three distinct areas 30, 32 and 34. Each of these areas 30, 32 and 34 has a width and a length wherein the length of each area is substantially the same as the length of the sheet of material 24.

Secured to the first area 30 of the underside 28 of the sheet 24 is an adhesive 36. The adhesive 36 is preferably a contact adhesive which is capable of being temporarily secured to the upper surface of the frame member 22 as shown in FIGS. 2 and 5. The adhesive 36 should be strong enough to maintain the wiper 10 in place but not so strong as to make it difficult to remove the same when desired.

A release paper 38 covers the adhesive 36 prior to use in order to prevent the adhesive from adhering to undesired products or other wipers. Prior to use, the release paper 38 is removed in order to expose the adhesive 36.

The second area 32 on the underside 28 of the sheet 24 includes a porous member 40 that also runs essentially the length of the sheet material 24. The porous member 40 carries a quantity of a liquid cleaning agent therein which can be released when it contacts the upper surface 12 of the belt 14. Preferably, the porous member 40 is made of a nonwoven, felt-like material that is capable of holding a significant quantity of the liquid cleaning agent. It has been found that a material sold under the trademark ZORB by Wazoodle Fabrics, LLC, of Bensalem, Pa., is very suitable as the felt-like material 40. This material is capable of holding a significant quantity of the liquid material. Furthermore, the liquid cleaning solution may also include an anti-bacterial solution.

In order to prevent the liquid from drying out before the wiper blade 10 is put to use, the porous member 40 is covered with a protective cover 42. This may be a film of liquid impermeable plastic that covers the porous member 40 and is adhered to the undersurface 28 of the material 24 until the wiper 10 is intended to be used. The protective coating 42 can then be merely stripped away to expose the porous member 40.

In the third area 34 of the undersurface 28 is a length of fibrous or foam material 44 that is capable of wiping dry the liquid from the porous member 40 that is applied to the upper surface 12 of the belt 14. The material 44 can be made of substantially any material that will spread and partially dry any liquid that is on the belt as it passes under the material 44.

Figures 3, 4:
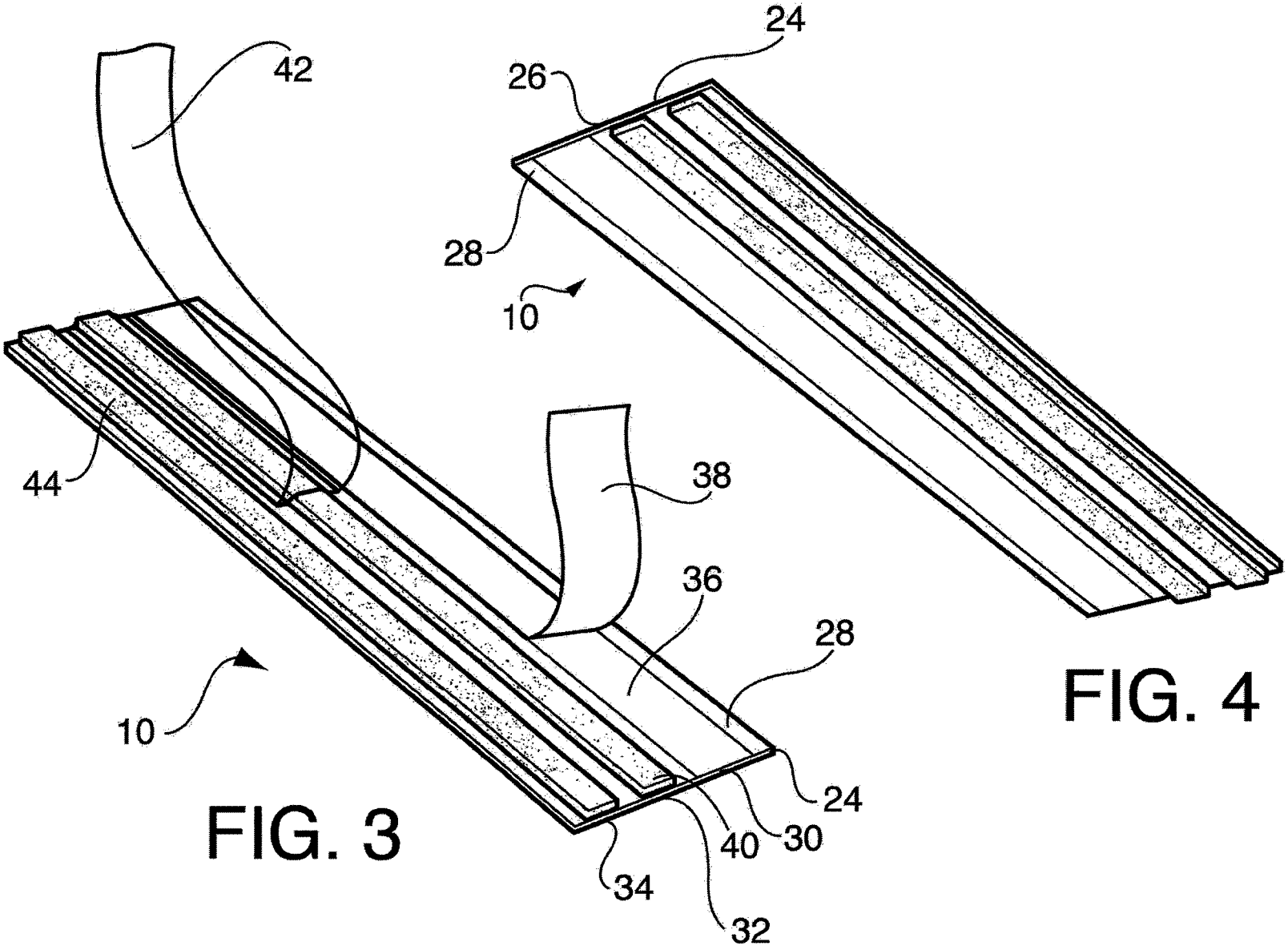
FIG. 3 is a perspective view of the bottom of the wiper of the invention showing the release papers being removed.
FIG. 4 is a view similar to FIG. 3 but showing the wiper of the invention with the release papers removed and ready to be applied to the conveyor.

The cleaning wiper 10 of the present invention is used in the following manner. First, the release paper 38 and the covering 42 are removed from the underside of the wiper 10 as shown in FIG. 3. The area 30 with the adhesive 36 thereon is then placed onto the frame member 22 adjacent the moving belt 14 as shown in FIGS. 1 and 2. The wiper 10 is arranged so that the porous member 40 and the drying or wiping member 44 press down slightly onto the upper surface 12 of the moving belt 14 as shown most clearly in FIG. 5. The wiper 10 can be left on for a day or more until it is clear that there is no longer any liquid being dispensed. It can then be easily removed, discarded and replaced.

While the wiper 10 has been shown as being substantially flat, it should be readily apparent to those skilled in the art that it can also be formed in a slight V configuration. This may be necessary if the frame member 22 extends downwardly at an angle toward the upper surface 12 of the belt 14 as described above. This can be accomplished by either forming the wiper 10 in the slight V shape or creating a crease or reduced area along the length of the material 26 between the adhesive area and the porous member and wiping area of the wiper 10. This would allow the same to bend or flex so as to accommodate different angles.

The present invention may be embodied in other specific forms without departing from the spirit or essential attributes thereof and accordingly, reference should be made to the appended claims rather than to the foregoing specification as indicating the scope of the invention.

I claim:

1. A cleaning wiper blade for a grocery conveyor wherein said conveyor includes an upper fixed frame member and a moving conveyor belt having a width and wherein said moving conveyor belt moves outwardly and away from under said frame member, said cleaning wiper blade comprising:

a thin sheet of material selected from the group consisting of paperboard, cardboard, plastic and metal, said sheet of material having a length, a width, an upper surface and a lower surface, said length of said material being essentially the same as said width of said conveyer belt;

first, second and third areas located on said lower surface of said sheet of material, each of said areas having a width and a length wherein the lengths of each of said areas are substantially the same and are substantially equal to said length of said sheet of material;

said first area including an adhesive thereon adapted to be temporarily secured to said frame member;

said second area carrying a porous member including a quantity of a liquid cleaning agent carried therein and adapted to be released therefrom onto said belt, and said third area including material capable of wiping said liquid from said belt;

whereby, said cleaning wiper blade is capable of being attached to said conveyor by securing said first area of said sheet of material to said frame member with said second and third areas contacting said upper surface of said belt.

2. The cleaning wiper blade as claimed in claim 1 further including a release paper covering said adhesive of said first area to protect the same, said release paper being capable of being removed to expose said adhesive when it is desired to use the same.

3. The cleaning wiper blade as claimed in claim 1 further including a protective covering for said second area covering the same to prevent said liquid cleaning agent from being released, said protective covering being capable of being removed to expose said porous member when it is desired to use the same.

4. The cleaning wiper blade as claimed in claim 2 further including a protective covering for said second area covering the same to prevent said liquid cleaning agent from being released, said protective covering being capable of being removed to expose said porous member when it is desired to use the same.

* * * * *